United States Patent [19]

Hartshorn

[11] Patent Number: 4,858,087

[45] Date of Patent: Aug. 15, 1989

[54] UNIVERSAL CIRCULAR ENCLOSURE FOR STANDARD STRIP FLUORESCENT FIXTURE

[75] Inventor: Gary Hartshorn, Glendale, Calif.

[73] Assignee: Lee Vande Sande, Glendale, Calif.

[21] Appl. No.: 44,966

[22] Filed: May 1, 1987

[51] Int. Cl.[4] ..... F21V 21/00; F21S 3/00

[52] U.S. Cl. ..... 362/219; 362/125; 362/225; 362/260

[58] Field of Search ..... 362/125, 147, 223, 224, 362/260, 368, 414, 217, 219, 222, 225, 249, 404

[56] References Cited

U.S. PATENT DOCUMENTS

| | | | |
|---|---|---|---|
| 2,336,416 | 12/1943 | Parker | 362/125 |
| 4,338,653 | 7/1982 | Marrero | 362/147 X |
| 4,420,798 | 12/1983 | Herst et al. | 362/368 X |
| 4,464,707 | 8/1984 | Forrest | 362/222 |
| 4,748,545 | 5/1988 | Schmitt | 362/219 |

*Primary Examiner*—Ira S. Lazarus
*Assistant Examiner*—Peggy Neils
*Attorney, Agent, or Firm*—John E. Wagner

[57] ABSTRACT

A fluorescent lighting enclosure system is disclosed which is designed to receive standard fluorescent strip lights of one or multiple lamp configuration and to support and enclose the fixtures in a readily adaptable form. The enclosure is in the form of continuous extrusions having internal tracks extending longitudinally along the full length of the extrusion. A novel spline is designed to fit in the tracks and act as a mount for the enclosure itself and for the fluorescent strips as well as to join the ends of enclosure sections and hold an end plate in place. The enclosure may be mounted with its light emitting opening directed in any direction including inverted. Perimeter lighting, grid and handrail lighting are all possible employing this invention with virtual 100% linear coverage using standard fluorescent fixtures.

16 Claims, 3 Drawing Sheets

UNIVERSAL CIRCULAR ENCLOSURE FOR STANDARD STRIP FLUORESCENT FIXTURE

BACKGROUND OF THE INVENTION

A recent important application of fluorescent lighting has been the use in retail establishments, and the like, of strip lighting, particularly those having a high truss roof and rows upon rows of shelving approximately six foot in height. In the past, it has been customary that ceiling suspended banks of fluorescent lighting have fairly well saturated the interior of the retail establishment from a distance well above the shelves.

With the advent of increased consumer awareness as to the labeling and content of the packages, particularly food packages, the ceiling suspended lighting, even though it involves a large number of fixtures, often fails to provide adequate illumination for the purchaser at chest height to read fine print on labels. As a result a relatively new type of lighting in the form of continuous tubular fixtures which is located at approximately the seven foot height above the floor and extending along the length of the shelves providing strip lighting has found broad acceptance.

The tubular cross section fixture allows a single or double strip fluorescent lighting fixture assembly to be enclosed within the tubular enclosure with a window and lens directed downward and in certain cases angled inwardly toward the shelf. Typically, the enclosures are six inches in diameter with approximately 120 degrees of a circle in the form of a curved linear fresnel lens to provide the desired lighting pattern.

Typically, tubular fixtures of this type have the fluorescent lamp and electrical lamp components integrated into the enclosure and the assemblies come in preassembled lengths usually slightly more than 8 feet in length to enclose a standard 8 foot fluorescent lamp assembly. The enclosure itself is usually extruded aluminum in the form of generally 240 degrees of circular cross section with internal bosses designed to provide support points for 120 degrees of lens and additional support points for the fluorescent lamp assembly. Examples of lighting fixtures of the type discussed above may be found in the following U.S. Patents:

| | | |
|---|---|---|
| 4,390,930 | Douglas J. Herst | June 28, 1983 |
| 4,420,798 | Douglas J. Herst | December 13, 1983 |
| 4,274,657 | Douglas J. Herst | July 10, 1984 |
| 4,573,111 | Douglas J. Herst | February 25, 1986 |

BRIEF DESCRIPTION OF THE INVENTION

I have found that significantly greater versatility for the tubular lighting fixtures may be obtained in which the enclosure is an extrusion of as great a length as is practical for extrusion and transportation purposes and not in any fixed standard lengths such as approximately 8 feet. If the rows of shelves are 30 feet in length, and extrusion and transportation capability of 30 foot enclosure is available then the enclosure length itself should be 30 feet.

Where, in certain cases, it is desirable to have the perimeter of a room served by the tubular lighting fixture, it can be accomplished with extrusions made to the full dimension of the room and beveled to match the corner angle, usually 90 degrees, and the extrusion joined together by welding for installation in the room without regard to the standard lengths of fluorescent fixtures. This is not to say that custom light fluorescent strip fixtures are required however, standard strip fixtures are available in lengths having multiples which give combinations down to one foot differences.

In accordance with this invention, the extrusion constitutes an enclosure, and, in fact, may be installed, and is recommended to be installed, prior to and separate from the fixture installation. Standard lighting fixtures are secured within the enclosures by simple splines and captured screws. If joints are required in the enclosure to extend to the full length of shelves or room size, these joints are secured by employing the same spline which holds the standard lighting fixture in position.

In one embodiment of this invention, the internal bosses are positioned to support a reflector. In another embodiment of this invention, additional side lighting is obtained by reason of the presence of spaced, aligned openings in the side wall of the extrusion.

A novel spline is configured to fit within a pair of integral bosses in the enclosure extrusion, one pair of splines are located directly opposite the lens opening and therefore provide a support for standard fixtures at any place along the length of the extrusion where the fixture requires or allows support. A number of these splines with captured screws are inserted from one end of the extrusion, there being at least two such splines for each fixture to be installed. The splines each include a pair of locking or set screws which when tightened engage the inner wall of the extrusion. These two sets of screws allow the spline to be used to join ends of adjacent lengths of extrusion with one or more set screws engaging each extrusion length. When the spline is used to support a fixture, the two set screws add to the stability of the fixture mounting. This use of a number of lengths of longitudinally movable splines, each lockable along any position, means that standard lighting fixtures of any available length can be placed and in tandem to provide the required length of illumination. Standard lengths readily available are: two feet, three feet, four feet, and eight feet.

When used in combination virtually any length of enclosure greater than two feet may be used.

Employing this invention, one additional unforeseen advantage occurs. That is, continuous strip lights may be placed end to end with only the sockets for the fluorescent lamps separating the ends of the fluorescent lamps. A virtually continuous illuminated strip is provided. Hardly any shadow is noticeable.

When this invention is used in a corner, one standard lighting fixture with its first fluorescent lamp is extended into the lighted corner nearly in contact with the side wall section and a second member nearly butting against the first fluorescent lamp providing fully illuminated corner.

We have found that it is possible to employ this invention for ceiling lighting as well as inverting the fixture holder. This can be done simply employing almost invisible support with the use of a cable secured by the spline of this invention in the longitudinal recess which is now located at the bottom and by passing the cable through an opening in the lens or between the ends of the adjacent lens section. An internal stabilizer cross bar is used which is likewise locked in the track.

In a further embodiment of this invention, a pair of external longitudinal grooves are located midway in the outside body. A channel with inward extending legs can be secured to rigid support from the ceiling to allow the enclosure to be installed after the support structure is in place and allows greater freedom in location of the wiring inner connection to the fixture and greater freedom in locating hanging devices.

Alternate forms of this embodiment include an ovoid shape which is particularly suitable for receiving a pair of fluorescent lamps and a generally rectangular shape fixture also is within the contemplation of this invention. This invention is further adaptable as a hand rail for a stairway to provide down lighting for the steps in an extremely attractive form. Each of these alternate embodiments employ the longitudinal groove and spline to support the fixtures as in the previous embodiments.

All together employing our invention, a significantly more effective tubular lighting system is obtained at substantially lower cost than heretofore possible. Likewise the enclosure of the invention allows the lighting fixture to be adaptive to the needs within one foot on length using only standard fixtures and in the case of peripheral room lighting, the enclosure can expand wall to wall, corner to corner. Also, employing this invention, a criss-cross lighting system may be produced with virtual illumination throughout the entire criss-cross areas.

BRIEF DESCRIPTION OF THE DRAWING

This invention may be more clearly understood from the following detailed description and by reference to the drawing in which.

DETAILED DESCRIPTION OF INVENTION

Figure 1:
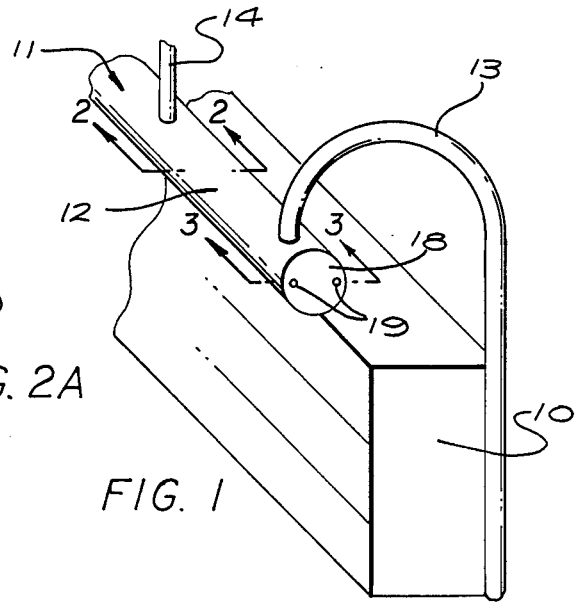
FIG. 1 is a perspective view of an installation of this invention.

Now referring to FIG. 1, a supermarket installation of this invention is illustrated, located in front of a bank of shelves 10, extending, for example, from 30–100 feet in length and having height in the order of 6 feet.

The lighting system of this invention generally designated 11, employs an extrusion having an overall length matching that of the shelf array and supported by a variety of means, two of which are illustrated in FIG. 1. First, an arched tube 13 extends from the rear of the shelves 10 to the floor and supplies operating current for the lighting fixture 11 from the floor. A second, and more common form of installation is by a down tube 14, extending from the ceiling or roof of the supermarket to support the assembly and to supply operating power from overhead. The arched tube 13 typically has a diameter of $\frac{3}{4}$ to three inches; can be used for this purpose. The down tubes 14 may be of similar size and piping or electrical conduit of that size may be used. Typically one or the other types of installation is used.

Figure 2A:
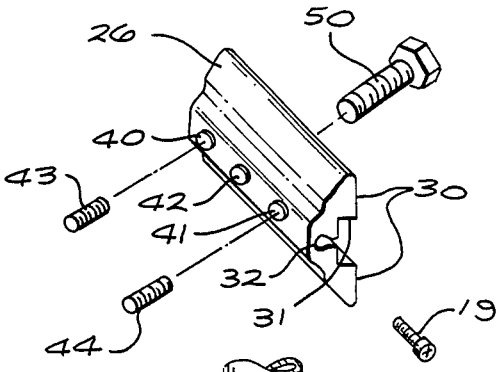
FIG. 2A is a perspective view of a typical spline forming a part of this invention.
Figure 2:
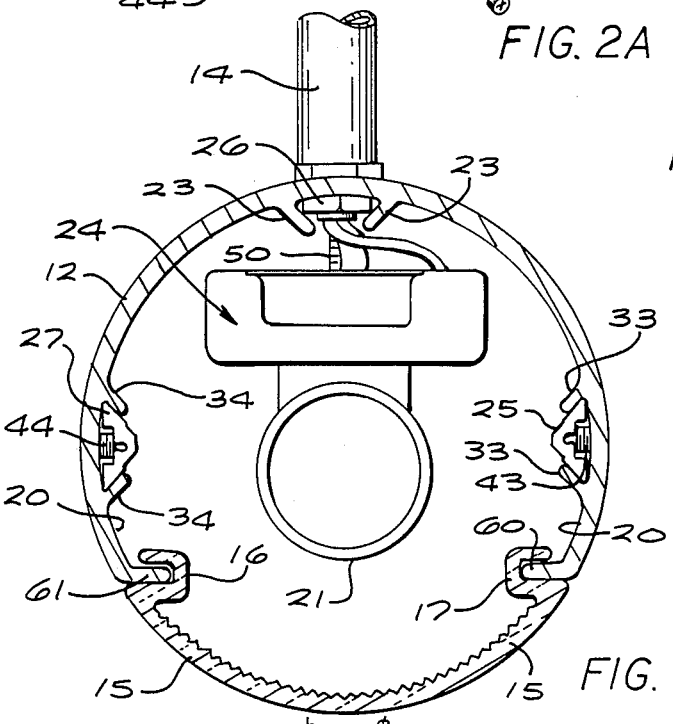
FIG. 2 is a vertical sectional view through a lighting enclosure in accordance with this invention taken along the line 2—2 of FIG. 1.

Now referring to FIG. 1 in combination with FIG. 2, the illumination function of this invention may be more clearly understood.

Enclosure or body 12 is typically fabricated of extruded aluminum having an outside diameter in the order ranging from 3–8 inches or ovoid in shape. The term extrusion is used because at the present time extruding is the most practical method of fabricating the enclosure body 12 to provide each of the required internal fittings and the suitable retainer for a lens 15, best seen in FIG. 2. The use of the term extrusion is not intended to limit the enclosure 12 to products produced by that process in as much as laid up fiberglass or roll formed sheet metal may well be used to form the enclosure 12. To this day, I find the extrusion process to be most effective and it is recommended as the best mode to carry out this invention.

The lens 15 includes edge hooks 16 and 17 which engage in the inner wall 20 of the body 12. The lens 15 is likewise preferred extruded in continuous strips from transparent material and includes on its inner or outer surface fresnel lens sections to provide the desired beam pattern from the light energy supplied by one or two strip fluorescent lamps 21, 22 located within the body 12 and secured, as is disclosed below in connection with FIG. 3, to an integral track 23.

A standard lighting fixture, generally designated 24, is suspended within the enclosure 12 by a series of machine screws captured within a number of splines of the type identical with joint splines 25 and 26 which appear in FIG. 2 which provide different functions. A typical spline 26 is illustrated in perspective view in FIG. 2A. The spline 26 shown therein is an aluminum extrusion of generally pyramid cross section having a slightly curved base 30 with a bolt head receiving recess 31 and a screw recess 32. The pyramid or angled walls of the spline 26 are shaped to conform with the inner surface of all of the standard tracks similar to track 23 of FIG. 2. A pair of such tracks 33 and 34 are shown in FIG. 2 each located toward the open lower side of extrusion 12. These tracks 33 and 34 are designed to receive splines 25 and 26 to join adjacent sections together.

THE SPLINES

Figure 3:
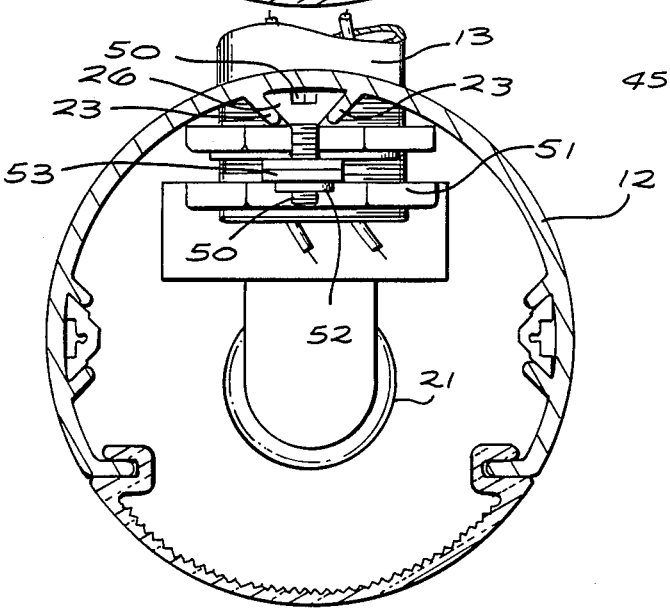
FIG. 3 is a vertical sectional view through a lighting enclosure in accordance with this invention taken along the line 3—3 of FIG. 1.

The splines, such as spline 26, are typically two inches or greater in length and include threaded openings 40 and 41, adjacent at each end, as well as a drilled unthreaded opening 42 towards the center. The threaded openings 40 and 41 are designed to receive set screws for locking the spline 26 into position as shown in FIG. 2. Set screws 43 and 44 engaging the inner wall of the extrusion 12, as may be seen in FIG. 2. A captured machine screw 50 as best seen in FIGS. 2A and 3 extends through machine screw opening 42, out of the track 23 and into a lamp base or canister 51 of FIG. 3 which is held in place by machine screw 50. The splines 26 holding the fixtures 24 may be moved freely longitudinally to align the machine screw 50 with its matching opening in the base of the fixture 51 where upon tightening of its own locking nut 52 of FIG. 3 locks the spline 26 longitudinally from any further movement.

It may therefore be seen that the single shape of the spline 26 provides both the function supporting the lighting fixture as well as joining sections of the enclosure. The spline 26 employing its end screw groove 32 also provides a recess for receiving a screw 19 from an end plate 18 of FIGS. 1 and 2A to hold the end plate 18 in place at the end of each section as illustrated in FIG. 1. Therefore, it may be seen that the simple spline 26 actually provides no less than four functions in this system.

When making an installation, the installer need only slide into the track 23, enough splines 26 for each joint in the length plus two or possibly three splines 26 for each fixture to be mounted. They can be left loose in track 23, for the present, to be tightened as required. An extra spline 26 or two resting in the track 23 presents no interference and may be used at a later date if any modification of the lighting system is required.

The splines 25 and 27 located adjacent to the open lower side of the extrusion 12 may be inserted as each section is added or slid in from the end after the enclosure 12 has been suspended.

The support of the lighting fixture in the track 23 is best illustrated in FIG. 3, in which the machine screw 50 extends downward through the rear face of fixture canister 51. Suitable spacers such as washers 53 may be used to position the fluorescent lamp 21 at the appropriate depth into the extrusion 12.

FIG. 3 also illustrated that the support 13 or feed conduit may extend through the enclosure 12, through a knock-out in the fixture body 51 and is secured the fixture as by outer and inner nuts in a conventional manner.

The lens 15 may be seen as engaging inwardly protruding lips 60 and 61 of the extrusion 12. Integral hooks 16 and 17 of the lens 15 employ the resiliency of the body of the lens 15 to allow the lens 15 to be snapped out over the protruding lips 60 and 61 of extrusion 12. The lens 15 may be easily removed and by pressing one edge toward the other edge to unhook one side of the lens 15 allowing it to drop down. This allows free access to change fluorescent lamps 21 when required.

Figure 4:
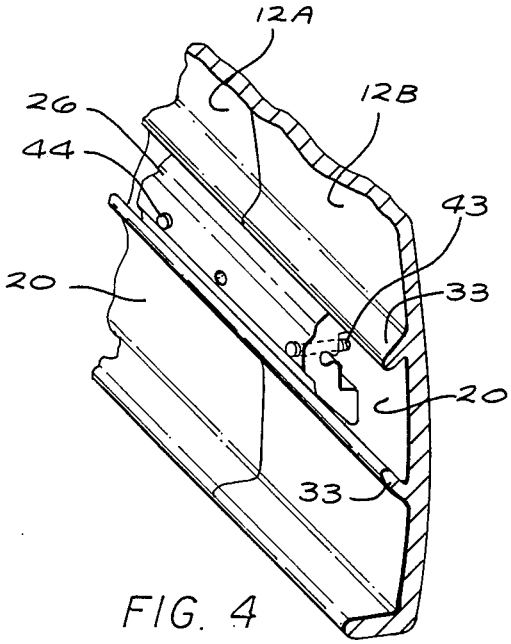
FIG. 4 is a fragmentary perspective view of a joint between sections of the enclosures of FIGS. 1-2.

An illustration of the use of the spline 26 to join a pair of sections 12A and 12B, is presented in FIG. 4. The spline 26 rests within the track 33 and employs its two set screws 43 and 44, at opposite ends to bear against the inner wall 20 of extrusion 12B. A similar set screw 44, is in engagement with the inner wall of section 12A. The cooperation of the extruded tracks 33, the spline 26 and set screws 43 and 44 provide a reliable joint. Access to the joints is freely available when the lens 15 is removed.

Figure 6:
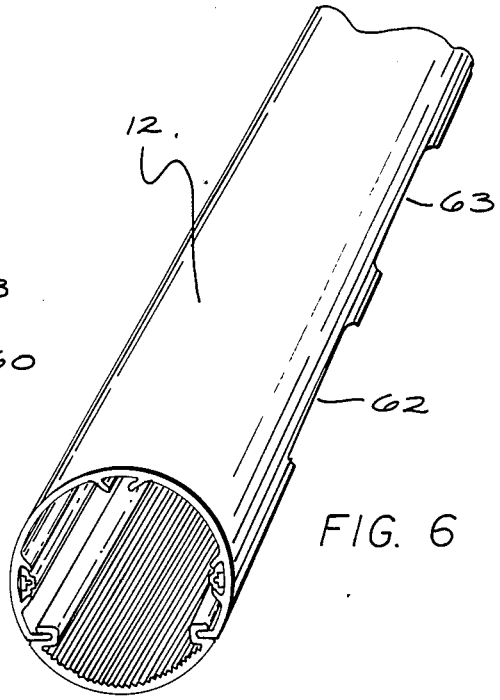
FIG. 6 is a perspective view of an alternative form of this invention providing side lighting.

Now referring to FIG. 6, an alternative embodiment of this invention is illustrated there in which elongated openings, for example, 8 inches in length by one inch wide separated by 4 inches have pierced the extrusion 12 providing openings 62 and 63. These openings 62 and 63 will allow a lateral light pattern where desired, to provide more general room illumination as well as directed illumination. An ideal location for the side openings is in the tracks 33 and 34 which may be used to hold lens in the side openings 62 and 63.

Figure 8:
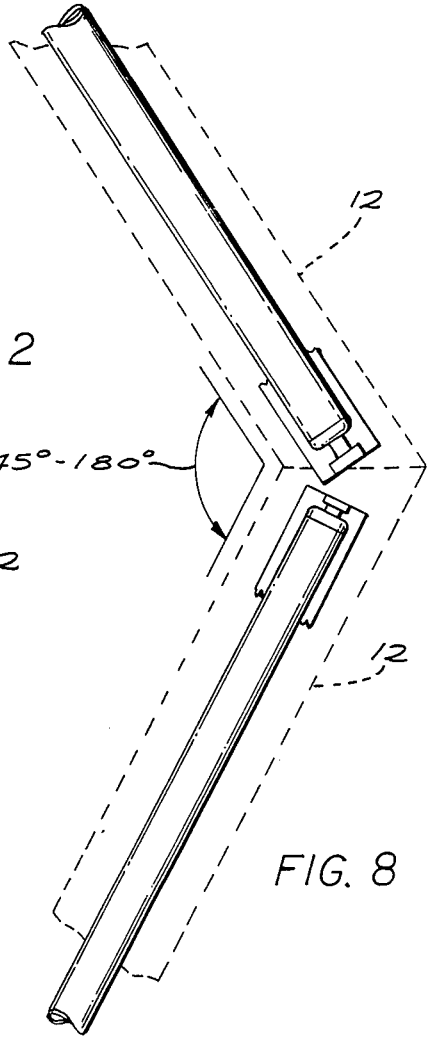
FIG. 8 is a fragmentary phantom view of a lamp arrangement giving virtually 100% illumination coverage.
Figure 5:
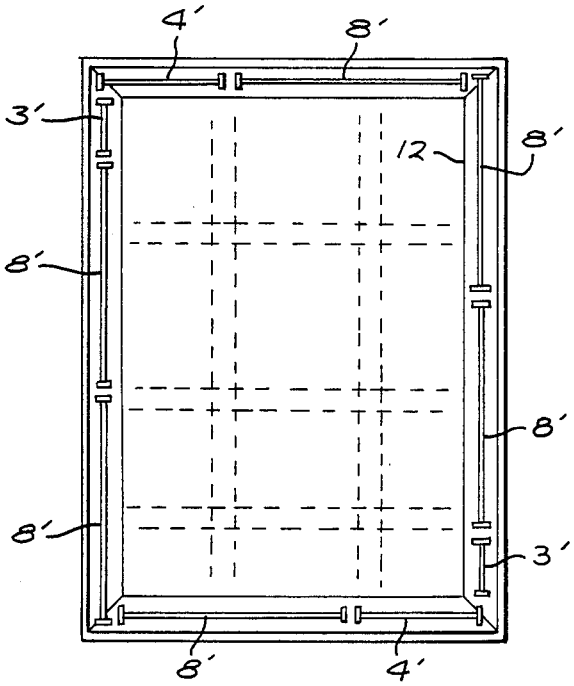
FIG. 5 is a room layout employing this invention.

Now referring to FIG. 5, in conjunction with FIG. 8, another advantage of this invention may be seen. FIG. 5, shows this invention for peripheral lighting to a room having an arbitrary dimension of 20 feet by 13 feet. Any single foot increment size room can be adapted in this same manner. The example of FIG. 5 employs a large number of different size of fixtures, using namely standard three foot, four foot, and eight foot lamps; however by selection of a combination of lamp sizes from these plus two foot length, peripheral lighting in which the extrusions 12 extend all the way to the corner may be achieved. In the case of FIG. 5, the extrusions 12 may be single lengths, two at 20 foot length and two at 13 foot length cut at a 45 degree bevel and then welded or otherwise joined together to provide right angle corners. When the enclosures 12 themselves are installed, the light fixtures with their lamps may be installed afterward in the arrangement shown.

In FIG. 5, a grid lighting pattern is illustrated by the dashed lines employing eight foot and four foot lamps, same as in the peripheral lighting of FIG. 5. Near continuous illumination is achieved in this manner.

Near continuous lighting is accomplished employing this invention since the only discontinuity need be at the corners or ends of lamps or where the two sockets are placed back to back as would occur in straight line portions of FIG. 5. At corners such as the 120 degree corner illustrated in FIG. 8, one lamp can be run nearly to the end and the other lamp brought in near contact with the end of the socket to provide a nearly 100% illuminated surface. This has not been achievable in the past.

Figure 7:
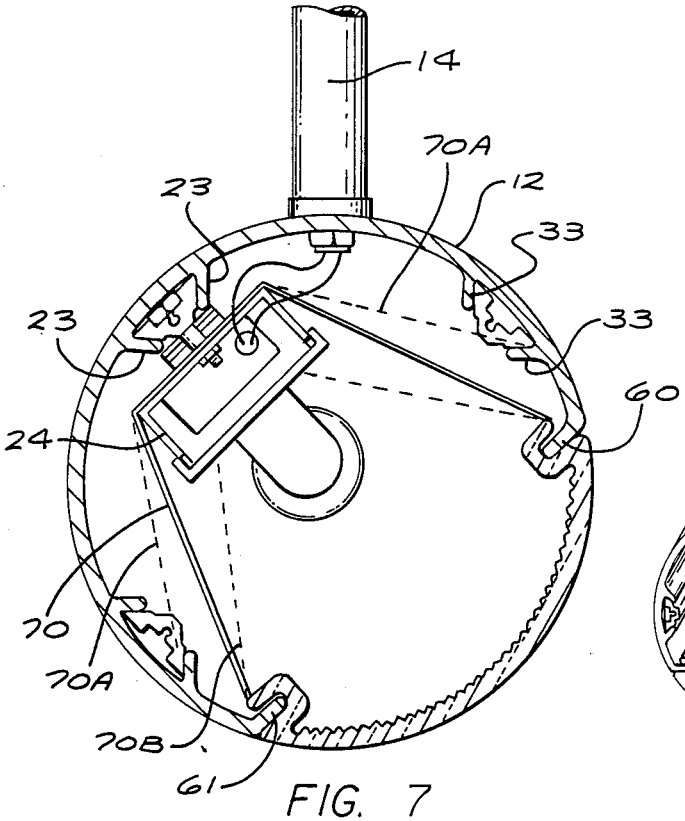
FIG. 7 is an end view of an alternate form of mounting of this invention.

In each of the embodiments so far, the lens and illumination has been directed downward. There is no such limitation on this invention. FIG. 7, illustrates the tipping of the fixture by approximately 45 degrees. The only change required is that a drilled hole for receiving the down tube 14 is no longer located in the track 23, but in the uninterrupted body 12. The only change required is the location of the drill hole.

INTERNAL REFLECTOR VERSION

Another feature of this invention is illustrated in FIG. 7, in that reflectors for the fixture may be placed in the housing in no less than three different locations. The solid line 70 illustrates a reflector with its ends captured in the corner defined by the inner extending protruding lips 60 and 61. The reflector 70 is captured behind fixture 24 by the same machine screw and nut which locate and secure the fixture.

An alternate position for the reflector 70 shown by dash lines 70A representing reflector 70A using the track 33, to secure its ends. The third position for the reflector is illustrated by the dash outline 70B, captured by the corner of the planes 60 and 61 and resting against the inner face of the fixture 24.

In each of the above embodiments standard lighting fixtures are used and the customizing is limited to the enclosure length and shape of the room or installation requirements merely a drill and a metal cut-off saw is required to customize the enclosure in the field.

INVERTED INSTALLATION

Figure 9:
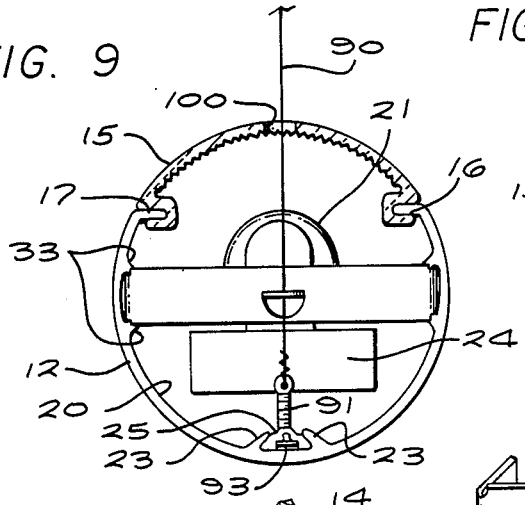
FIG. 9 is a vertical sectional view through an enclosure of this invention in an inverted suspension form.

This invention may be applied to installations calling for ceiling or indirect lighting. This feature is illustrated in FIG. 9 in which the same enclosure of FIGS. 2, 3, or 6 is used employing the splines 26 of FIG. 2A.

Figure 10:
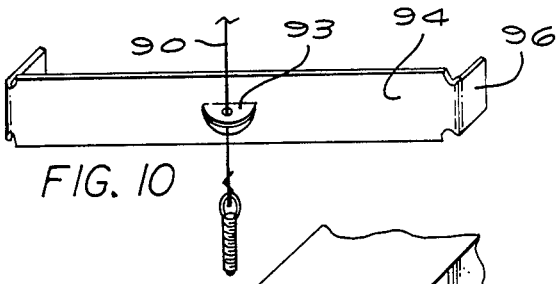
FIG. 10 is a perspective view of a stabilizer bar used in the embodiment of FIG. 9.

When inverted, the enclosure 10 is preferably supported by a cable 90 from the overhead, unshown in the drawing and attached to the enclosure 10 by a spline 25 of the type shown in FIG. 6. The cable 90 ends in a threaded fastener 91 held by a captured nut 92 in spline 25. The cable 90 passes through an opening in an integral tab 93 of stabilizer bar 94, best seen in FIG. 10. End tabs 95 and 96 of stabilizer bar 94 rest in the tracks 33 and 34 respectively of FIG. 9.

Cable 90 passes through an opening 100 in lens 15 or may pass between the ends adjacent lens sections. The use of a cable and stabilizer bar is preferred in order to minimize the visibility of the support structure although conduit or pipe supports similar to those disclosed in FIG. 1 may be used. In such case, the conduit or pipe must pass through the lens 15 and between the end of adjacent fixture 24 or an J shaped support similar to support 13 of FIG. 1 is to be used.

UNIVERSAL SUSPENSION

In certain cases it is desirable to install the support structure for the lighting in advance of the actual enclosure and simply slide the enclosure in place, secure it and thereafter install the fixtures and lamps. In the embodiments described above, the enclosures are lifted into position from below. Thus, my invention is subject to installation prior to mounting of the actual fixture and lamps and by either of two methods:

(a) raising the enclosures from below with predrilled openings for the hangers as supports; or (b) sliding from an accessible end the enclosure onto a horizontal track followed by drilling the enclosure to match the locations of conduits.

Figure 11:
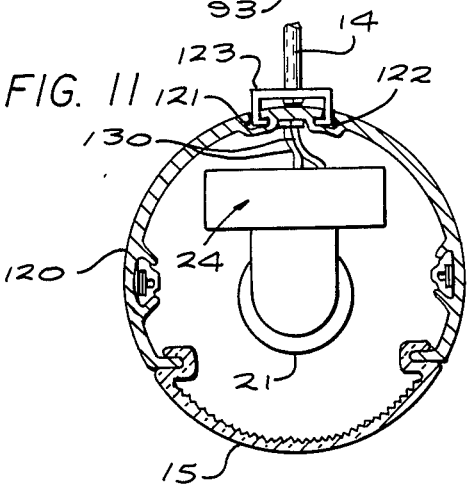
FIG. 11 is a vertical sectional view of the enclosure of this invention including an external longitudinal groove for mounting.

The latter method is accomplished employing the assembly of FIG. 11. The enclosure 120, is a modified form of the enclosure of 12 of FIGS. 1–3.

Figure 12:
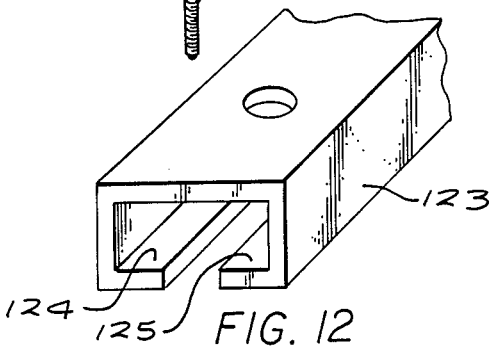
FIG. 12 is a fragmentary enlarged perspective view of the mounting bracket used in FIG. 11.

In this embodiment, the enclosure 120 includes an external track comprising a pair of longitudinal grooves 121 and 122 in place of the internal tracks 23 of FIG. 2. A channel member 123, best seen in FIG. 12, includes inward extending feet 124 and 125 which slide into grooves 121 and 122 of FIG. 11 to provide support for the enclosure 120. A hole drilled through both the channel member 123 and the wall of the enclosure 120 between the grooves 121 and 122 allows a support tube 14 to enter the enclosure 120 and be secured by a nut 126 which is held captive by the adjacent walls of the enclosure 120 defining the grooves 121 and 122. The tube 14 provides a conduit for the power feed wires 130 for the fixture 24 which may be supported in several ways including by a reflector, unshown, similar to FIG. 7.

OTHER ALTERNATIVE EMBODIMENTS

Figure 13:
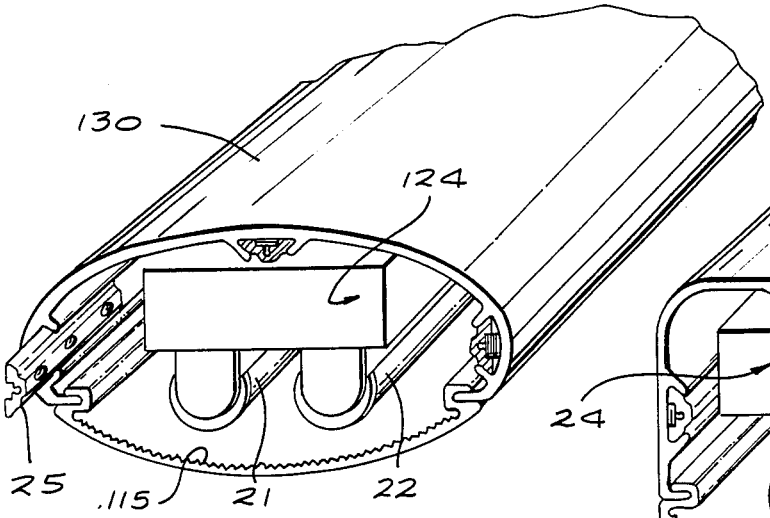
FIG. 13 is a fragmentary perspective view of an oviod shape enclosure incorporating this invention.
Figure 14:
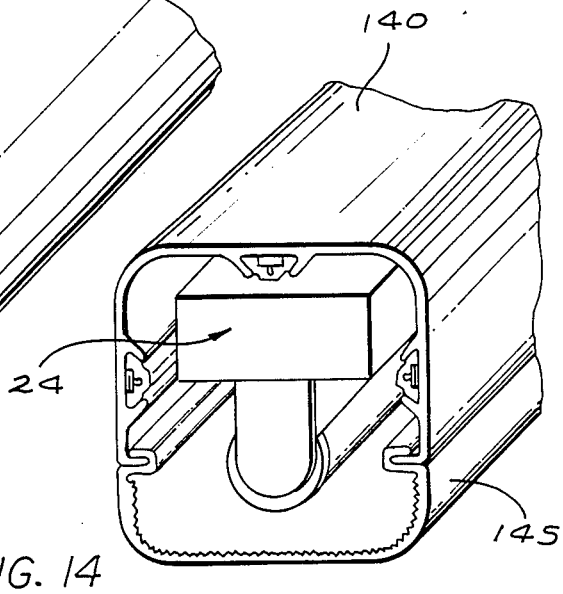
FIG. 14 is a fragmentary perspective view of a rounded corner, square cross-section, embodiment of this invention.

FIGS. 13 and 14 illustrate two other embodiments of this invention which are structurally similar to the embodiment of FIGS. 2, 3, and 7. In FIG. 13, the enclosure is in the form of an oviod with the lens 115 on a major face. This shape of enclosure is particularly adaptable to enclosing a multi lamp fixtures such as fixture 124 of FIG. 13. The arrangement for support and powering as used in FIGS. 1–3 is used with the embodiment of FIG. 13. One spline 25 is shown in its full length, extending beyond the end of enclosure extrusion 130 while the other two splines 25 are shown sectioned at the joint. The fixture of FIG. 13 provides a beam spread angle somewhat greater than the embodiment of FIGS. 2 and 3, improved efficiency in addition to its attractive ovoid shape.

FIG. 14 illustrates a rounded corner square or rectangular shape enclosure 140 carrying either a single lamp fixture 24, as illustrated, or a dual lamp fixture similar to fixture 124 of FIG. 13. The embodiment of FIG. 14 may be expanded in size laterally to provide a rectangular cross section with the lens 145 constituting a major face of the rectangle.

HANDRAIL EMBODIMENT

Figure 15:
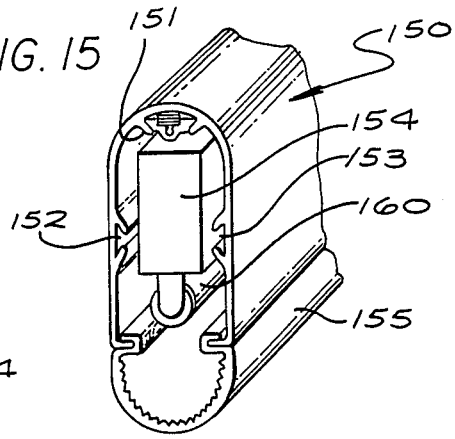
FIG. 15 is a fragmentary perspective view of this invention applied to a building stairway handrail.

Another particularly useful application of this invention is illustrated in FIG. 15. It is a downward beam lighted handrail 150 with a plurality of internal tracks 151, 152 and 153, the first of which mounts fixture 154 with its lamp 155 protected within the handrail enclosure 150 but illuminating the area below the handrail enclosure 150. The fixture 154, preferably has its internal ballast positioned on edge as compared with the normal flat positioning. This allows the lamp 160 to be located on the edge of the enclosure 154 and direct its illumination toward the stairs below. The two tracks 152 and 153 on the side walls of enclosure are available for use with splines 25 of FIG. 2A as reinforcements for the side wall of enclosure 150 in attaching a wall mounting bracket (unshown) to the handrail enclosure 150.

SUMMARY

Altogether, I have produced an efficient low cost enclosure for fluorescent lighting fixtures which is customized to each individual location yet uses standard fixtures throughout. The enclosure is limited in length only by practical extrusion and handling requirements resulting in minimum number of joints. It also allows near 100% linear light coverage. The enclosures and their lens snap fit together and are configured for effective nesting during shipping and storage.

A simple spline structure provides the multiple functions of:

(a) joining sections together;

(b) provides a physical mount for the enclosure;

(c) provides a physical mount for the lighting fixture;

(d) provides a securement for end plates;

(e) provides reinforcement for the enclosure at points of stress.

The enclosure may be installed prior to installation of the actual fixtures thereby significantly reducing the weight, time and cost of installation. A single worker can easily install a 16 foot section of this enclosure and then install regular fixture and deal with less weight at any one time.

Likewise this invention may be adapted on site to discrete length installation, inverted or side lighting, side augmented lighting, perimeter lighting, grid or strip lighting and handrail lighting, — all employed basically the same basic elements. The enclosure extrusion may be cut to length and assembled on site with a minimum of joints. A simple universal spline acts as a joint connector, fixture mount, end plate mount and support mount.

This invention shall not be limited to the illustrative embodiments but rather to the claims as set forth below which constitute definitions of this invention including the protection afforded by the doctrine of equivalents.

What is claimed is:

1. An enclosure for lighting fixtures comprising: an elongated open ended hollow member having an outer surface, an interior wall and an elongated light emitting opening therein;

said elongated hollow member including at least one integral track on the interior wall of said member for capturing a spline within said track;

a plurality of rigid splines dimensioned to enter the end of said member and move within said track and engage the interior surface of said member defining said track at various positions along said track;

longitudinally spaced means for securing said splines within said tracks wherein said splines may engage end regions of adjacent lengths of said elongated enclosure to lock said lengths into a continuous elongated structure; and additional means engaging said splines for securing a lamp fixture thereto.

2. The enclosure for lighting fixture in accordance with claim 1 which said enclosure is generally closed in cross section except for an interruption therein constituting the light emitting opening;

3. The enclosure for a lighting fixture in accordance with claim 1 wherein said track is at least two in number, each track located generally spaced from said light emitting opening whereby adjacent lengths of said enclosure may be secured together by said splines at spaced locations around the interior wall of said elongated hollow member.

4. The enclosure for a lighting fixture in accordance with claim 1 wherein said at least one track is located generally opposite the light emitting opening for mounting a fixture thereon wherein splines located within said one track supports lighting fixtures within said enclosure and including additional tracks enclosing additional splines joining adjacent sections of elongated hollow members together to define a continuous lighting fixture enclosure.

5. The elongated enclosure for a lighting fixture in accordance with claim 1 wherein said splines include said additional means for securing a lighting fixture thereto.

6. The enclosure for lighting fixtures in accordance with claim 5 said additional means for securing a lighting fixture to said spline comprises a bolt captured between said spline and said enclosure.

7. The enclosure in accordance with claim 1 which further includes a mounting groove opening open to the outer surface of the enclosure extending longitudinally to allow support at any point along the length of the enclosure via said keyed slot.

8. An enclosure in accordance with claim 3 wherein said tracks are integral with the interior wall of said enclosure and wherein;

said spline include a surface generally conforming to the interior wall of said elongated hollow member within said track for free movement longitudinally within said track and include longitudinally spaced locking means whereby said spline may be secured to said enclosure at two spaced locations on the interior wall of said enclosure.

9. An enclosure in accordance with claim 1 wherein said splines include a bolt head receiving recess therein and a bolt opening therethrough whereby a bolt may be captured and used to secure fixtures within said enclosure.

10. An enclosure in accordance with claim 3 wherein at least one of said tracks is located on outer surface of said enclosure and extends longitudinally thereon.

11. An enclosure in accordance with claim 1 or claim 3 wherein said enclosure is ovoid in shape and said light emitting opening is located on a major face thereof.

12. An enclosure in accordance with claim 1 or claim 3 wherein said enclosure is generally rectangular in cross section having four outer generally planar surfaces and said light emitting opening constitutes at least one of the generally planar outer surface thereof.

13. An enclosure in accordance with claim 1 or claim 3 wherein said enclosure is deeper than it is wide thereby providing two wider sides and two narrower sides and said light emitting opening is located on one of the narrow sides thereof whereby said enclosure may be positioned to constitute a lighted handrail.

14. An enclosure in accordance with claim 1 for inverted installation including one track within said enclosure located on the inner surface of said enclosure remote from said light emitting opening;

said enclosure adapted to receive a support member through said light emitting opening; and means secured to said enclosure extending into the hollow of said enclosure for stabilizing a support member secured to said enclosure.

15. An enclosure in accordance with claim 14 wherein said enclosure includes an additional track and said stabilizing means engages said additional track.

16. An enclosure in accordance with claim 15 wherein said enclosure includes a pair of additional spaced tracks and said stabilizer means comprises a bar extending between said pair of additional tracks.

* * * * *